United States Patent [19]

Nesbitt et al.

[11] Patent Number: 5,044,638

[45] Date of Patent: Sep. 3, 1991

[54] GOLF BALL

[75] Inventors: R. Dennis Nesbitt, Westfield; Joseph F. Stiefel, Shrewsbury, both of Mass.

[73] Assignee: Spalding & Evenflo Companies, Inc., Tampa, Fla.

[21] Appl. No.: 544,554

[22] Filed: Jun. 12, 1990

[51] Int. Cl.[5] ..... A63B 37/14

[52] U.S. Cl. ..... 273/232; 40/327

[58] Field of Search ..... 273/232, 213; 40/327

[56] References Cited

U.S. PATENT DOCUMENTS

| | | | |
|---|---|---|---|
| 4,560,168 | 12/1985 | Aoyama | 273/232 |
| 4,729,861 | 3/1988 | Lynch et al. | 264/219 |
| 4,804,189 | 2/1989 | Gobush | 273/232 |
| 4,813,677 | 3/1989 | Oka et al. | 273/232 |
| 4,840,381 | 6/1989 | Ihara et al. | 273/232 |
| 4,915,390 | 4/1990 | Gobush et al. | 273/232 |
| 4,936,587 | 6/1990 | Lynch et al. | 273/232 |

*Primary Examiner*—George J. Marlo

*Attorney, Agent, or Firm*—Donald R. Bahr; John E. Benoit

[57] ABSTRACT

A dimpled configuration for a golf ball wherein the dimples are arranged in a configuration so as to provide a dimple-free equatorial line, with each hemisphere of the ball having six identical dimpled substantially mating sections with a common dimple at each pole. Each section comprises six dimples lying substantially along a line parallel with but spaced from the equatorial line, twenty-nine dimples between the six dimples and the common polar dimple, with the outer dimples of each of said sections lying on a modified sinusoidal line. The ball preferably has 422 dimples.

7 Claims, 1 Drawing Sheet

GOLF BALL

This invention relates generally to golf balls and more particularly to a specific arrangement of the dimples on a golf ball.

It is generally known that for any given selected number of dimples on a golf ball, it is desirable that the area of the surface of the golf ball covered by the dimples be arranged so as to provide the best flight characteristics for a golf ball. In British Patent Provisional Specification Serial No. 377,354, filed May 22, 1931, in the name of John Vernon Pugh, there is disclosed the fact that by the use of an icosahedral lattice for defining dimple patterns on a golf ball it is possible to make a geometrically symmetrical ball. This icosahedral lattice is developed by the known division of a sphere or spherical surface into like areas determined by an inscribed regular polyhedron such as an icosahedron. The Pugh specification specifically details the means of plotting the icosahedron on the surface of the golf ball and, accordingly, will not be dealt with in detail here. Thus, with a selected number and size of the dimples placed in this icosahedral pattern, the area of the surface of the ball covered by the dimples is fixed.

A problem arises with the Pugh icosahedron golf ball in that there is no equatorial line on the ball which does not pass through some of the dimples on the ball. Since golf balls are molded and manufactured by using two hemispherical half molds normally having straight edges, the ball, as it comes from the mold, has a flash line about the equatorial line created by the two hemispheres of the mold. Such molding results in a clear flash line. Even if the ball could be molded with dimples on the flash line, the ball could not be properly cleaned and finished in any efficient manner since the flash could not be cleaned from the bottom of the dimple without individual treatment of each dimple.

The Pugh ball is geometrically and substantially aerodynamically symmetrical. Any changes in dimple location which affect the aerodynamic symmetry under U.S.G.A. standards will render the ball illegal for sanctioned play. Many proposals have been made and balls have been constructed with a modification of the Pugh icosahedral pattern so as to provide an equatorial line which is free of dimples. Again, it is emphasized that any such modification must be aerodynamically symmetrical.

U.S.G.A. rules of golf require that the ball shall be designed and manufactured to perform in general as if it were aerodynamically symmetrical. A golf ball which is dimpled in some manner may be geometrically symmetrical and not aerodynamically symmetrical. A perfect example of a golf ball which is both geometrically symmetrical and aerodynamically symmetrical is a smooth sphere. As is well known, this ball is not capable of providing the necessary performance required in present day golf To conform, all balls must be aerodynamically symmetrical within limits set by U.S.G.A. rules. This symmetry is determined by actual tests of the ball as it is being struck by a machine which belongs to the U.S.G.A.

While balls in use today generally fall within U.S.G.A. rules as to symmetry, there is substantial room for improvements which would approach absolute symmetry.

Accordingly, it is an object of the present invention to provide a dimple pattern on the surface of a golf ball which improves the flight symmetry of existing balls.

Another object of this invention is to provide a dimple pattern on a golf ball which is different than the standard icosahedral or dodecahedral modified patterns and which improves the flight symmetry of the golf ball.

These and other objects of the invention will become apparent from the following description taken together with the drawings.

BRIEF SUMMARY OF THE INVENTION

The present invention discloses a dimpled configuration for a golf ball wherein the dimples are arranged in a lattice configuration so as to provide a dimple-free equatorial line, with each hemisphere of the ball having six identical dimpled sections with a common dimple at each pole. Each section comprises six dimples lying substantially along a line parallel with but spaced from the equatorial line and twenty-nine dimples between the six dimples and the common polar dimple with the outer dimples on one side of a section lying substantially next to the outer dimples on the other side of the next adjacent section.

DETAILED DESCRIPTION OF THE PREFERRED EMBODIMENT

The present invention has a dimple pattern which provides substantially identical sections having a particular dimple arrangement. Each hemisphere of the ball has six such sections, with the hemisphere being divided by a dimple-free line on the equator of the ball.

Figure 1:
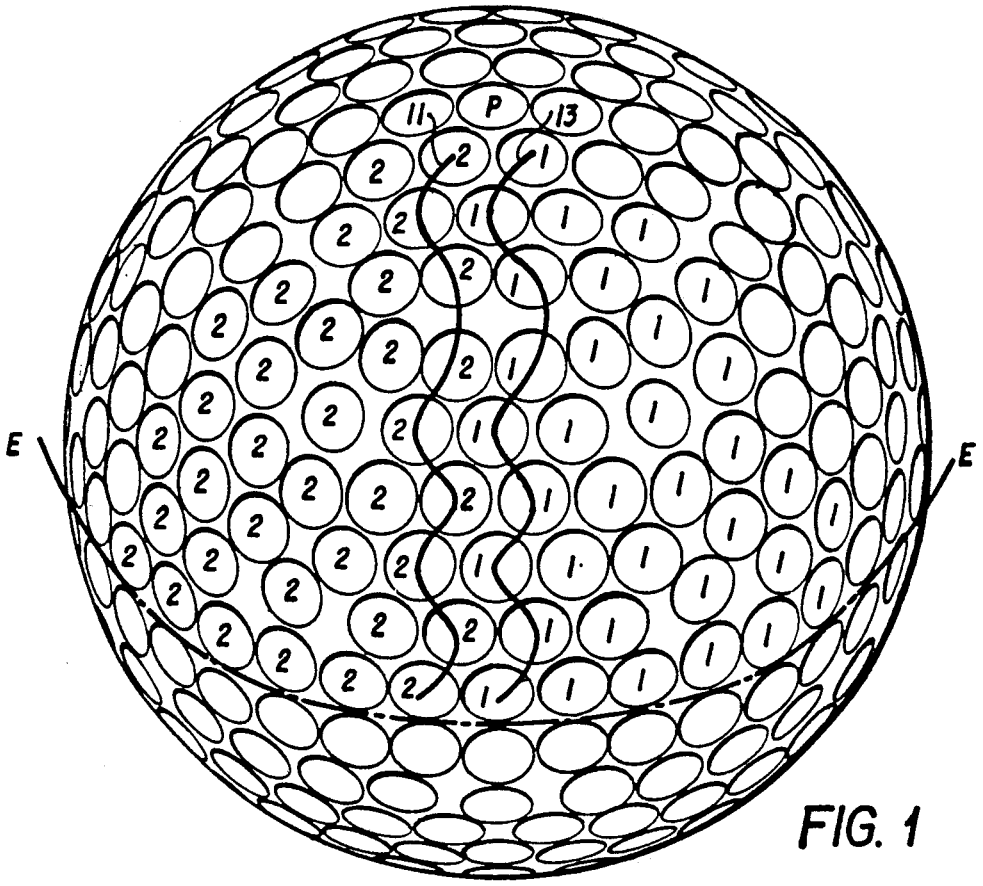
FIG. 1 is a plan view taken along an offset line from the equatorial line of the ball showing both the pole of one hemisphere and the equator.

Two of the identical sections are identified in FIG. 1, with the dimples in one section being labeled 1 and the dimples in the second section being labeled 2. It is to be understood that there are six sections on either side of the equator having identical dimple configuration, with all sections having a common polar dimple P. The remaining dimples are not identified for purposes of clarity of the illustration. The equator is designated as E-E and provides the area for the flash line as the balls are made in standard molds.

Figure 3:
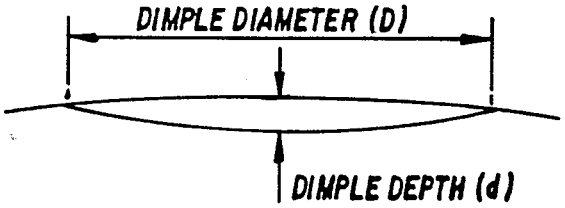
FIG. 3 is a schematic illustration of the dimple diameter and depth.

FIG. 3 is a schematic illustration of a cross-section of one of the dimples used on the ball of the present invention and shows dimple diameter D and dimple depth d. All of the dimples on the ball of the present invention have substantially the same diameter D and depth d. These dimensions, as discussed subsequently, refer to the finished ball.

Figure 2:
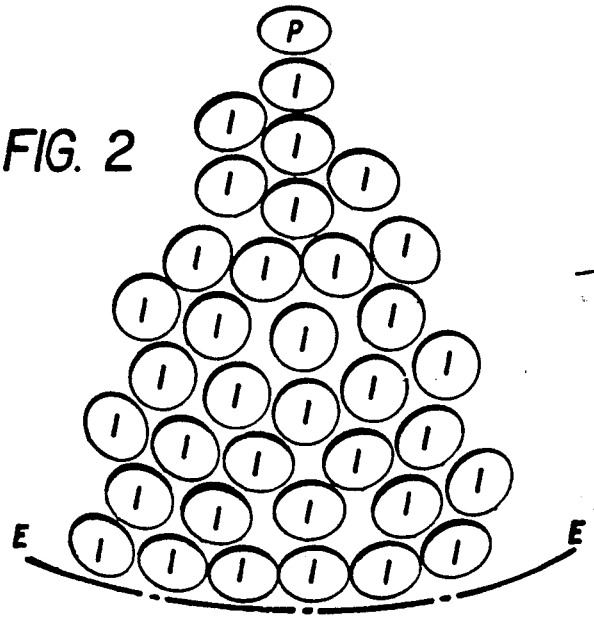
FIG. 2 is a diagramatic presentation of one of the sections of the ball of FIG. 1.

FIG. 2 discloses one of the sections as illustrated in FIG. 1. As can be seen, there are six dimples lying substantially along a line parallel to but spaced from the equator E. Twentynine dimples are selectively placed between the dimples lying in the line parallel to the equator and the polar dimple Referring to FIG. 1, it can be seen that the outer dimples along one side of a section lie on line 11, which is a modified sinusoidal curve. Dimples 2, which are located on line 11, lie substantially next to the outer dimples 1 of the opposite side of the next section. Outer dimples 1 are located along sinusoidal line 13, which is substantially identical to line 11. Thus, the specific relationship between the dimples 1 in the first section and the dimples 2 in the next adjacent section results in a pattern over the surface of the ball wherein the dimples define a repetitive pattern about the surface area of the ball.

There is one polar dimple and 210 patterned dimples on each hemisphere, with each of the six sections in the pattern having 35 dimples, whereby the total number of dimples covering the golf ball surface is 422. All of the dimples have substantially the same diameter D and substantially the same depth d. With the configuration as shown, the diameter D of the dimples is substantially 0.140 inch and the depth d of the dimples is substantially 0.0101 inch.

Tests were conducted using a machine similar to the U.S.G.A driving machine wherein a driver having a head speed of 160 feet/second at point of impact drove a ball configured in accordance with the present invention a carry distance of 254.0 yards and a roll distance of 22.7 yards, for a total distance of 276.7 yards. This is within the allowed U.S.G.A. standard of 280.0 yards The ball of the present invention also has good flight symmetry regardless of tee-up positioning.

As provided in substantially all golf balls made today, the dimple-free equatorial line permits finishing the ball in a mechanical fashion to remove the flash line without disturbing the dimple configuration since the flash line exists along the equator, which is dimple-free.

It is to be understood that the above description and drawings are illustrative only and that the invention is to be limited only by the scope of the following claims.

We claim:

1. A golf ball having a dimpled surface, the configuration of said dimples comprising a dimple-free equatorial line on said ball dividing said ball into two hemispheres;

a dimple at each pole of said ball;

six identical dimple sections on each side of said equatorial line; each of said sections comprising six dimples lying substantially along a line parallel with but spaced from said equatorial line; and twenty-nine dimples between said six dimples and said dimple on the pole of the associated hemisphere.

2. The golf ball of claim 1 wherein the outer dimples on one side of a section lie substantially next to the outer dimples on the other side of the next adjacent section.

3. The golf ball of claim 1 wherein the diameter D and depth d of all dimples are substantially identical.

4. The golf ball of claim 3 wherein the diameter D of all dimples is substantially 0.140 inch and the depth d is substantially 0.0101 inch.

5. The golf ball of claim 1 wherein the outer dimples of said 29 dimples in each section lie along a modified sinusoidal curve.

6. The golf ball of claim 5 wherein said outer dimples on one side of a section lie substantially next to the outer dimples on the other side of the next adjacent section.

7. A golf ball having a dimpled surface, the configuration of said dimples comprising a dimple-free equatorial line on said ball dividing said ball into two hemispheres;

a dimple at each pole of said ball;

six identical substantially mating dimple sections on each side of said equatorial line, each of said sections comprising a plurality of dimples lying substantially along a line parallel with but spaced from said equatorial line;

a plurality of dimples lying along a modified sinusoidal curve at the outer sides of said section, said modified sinusoidal curve extending between said dimple at said pole and the outer dimples of said plurality of dimples lying substantially along a line parallel to said equatorial line; and a plurality of dimples within each section.

* * * * *